US006260729B1

(12) United States Patent
Mitchell et al.

(10) Patent No.: US 6,260,729 B1
(45) Date of Patent: Jul. 17, 2001

(54) ARTICLE FOR FOOD SEALING AND STORAGE

(76) Inventors: Brian L. Mitchell, 303 50th Ct., Meridian, MS (US) 39305; Richard W. Nunn, 15080 SW. Millikan Way #1227, Beaverton, OR (US) 97006

( * ) Notice: Subject to any disclaimer, the term of this patent is extended or adjusted under 35 U.S.C. 154(b) by 0 days.

(21) Appl. No.: 09/570,866

(22) Filed: May 15, 2000

Related U.S. Application Data

(60) Provisional application No. 60/135,990, filed on May 25, 1999.

(51) Int. Cl.[7] ..... B65D 41/22

(52) U.S. Cl. ..... 220/287; 220/780; 150/154

(58) Field of Search ..... 220/287, 281, 220/305, 780, 782; 215/319; 206/304.1; 224/42.12; 150/154

(56) References Cited

U.S. PATENT DOCUMENTS

| | | | | |
|---|---|---|---|---|
| 2,080,108 | * | 5/1937 | Brandstein | 220/287 |
| 3,519,163 | * | 7/1970 | Bardell | 220/782 |
| 3,557,995 | * | 1/1971 | Mirasol, Jr. et al. | 220/782 |
| 4,901,881 | * | 2/1990 | McElroy | 220/287 |
| 5,390,810 | * | 2/1995 | Stroble et al. | 220/281 |

* cited by examiner

*Primary Examiner*—Nathan J Newhouse
(74) *Attorney, Agent, or Firm*—John Wiley Horton

(57) ABSTRACT

The proposed invention comprises a highly elastic sealing cover for covering food containers or dishes. It is capable of replacing existing rigid covers or plastic wrap/aluminum foil. The elastic nature and design of the proposed invention allow it to provide a more air-tight seal than plastic wraps or aluminum foil on a wide range of sizes and shapes of dishes or other food storage items. It can also conform to objects bulging out of containers (i.e., a head of lettuce).

3 Claims, 8 Drawing Sheets

ARTICLE FOR FOOD SEALING AND STORAGE

This application claims the benefit of U.S. Provisional Application Ser. No. 60/135,990, filed on May 25, 1999.

BACKGROUND

1. Field of Invention

The present invention is designed for food storage. More specifically, the invention comprises a lid or cover for sealing existing containers so that they are air-tight.

2. Description of Prior Art

Food storage containers have been in common use for decades. TUPPERWARE brand products come in many shapes and sizes. These containers are commonly molded from a thermoplastic resin, such as polypropylene. Each container has a corresponding lid, which is sized to hermetically seal the container. Unfortunately, once a user has several different sizes of these containers, it becomes difficult to match a lid with its container. Additionally, lids are often damaged or lost, rendering the corresponding container useless. It would therefore be desirable to have an adaptable lid which would be capable of hermetically sealing a variety of containers.

Another method of sealing and preserving foods is to use SARAN plastic wraps or aluminum foil. The user typically places these protective coverings over an open container or dish. This process is wasteful, as the plastic wrap or aluminum foil is typically discarded once the food is removed from storage.

The prior art devices are therefore limited in that they are:

1. Restricted to use with one particular type of container; and
2. Not reusable.

OBJECTS AND ADVANTAGES

Accordingly, several objects and advantages of the present invention are:

1. To provide a cover which can be used with a variety of different containers;
2. To provide a cover which can be washed and reused numerous times;
3. To provide a cover which is sufficiently elastic to stretch over a wide variety of foodstuffs; and
4. To provide a cover which can be mass produced at a relatively low cost.

DRAWING FIGURES

REFERENCE NUMERALS IN DRAWINGS

| | |
|---|---|
| 10 | cover |
| 12 | top panel |
| 14 | gasket ring |
| 16 | accordion section |
| 18 | corrugation |
| 20 | container |
| 22 | container lip |
| 24 | undercut |

DESCRIPTION OF THE INVENTION

The proposed invention is designed to provide either a replacement or alternate cover for existing food containers, or to provide a means of storing food in a dish, can, or other serving piece. In this second application, the invention is intended to replace aluminum foil, plastic wrap, and the like. The elastic nature and design of the proposed invention allow it to provide a more tight seal than plastic wraps or aluminum foil on a wide range of sizes and shapes of dishes or other food storage items. Being highly elastic, the proposed invention can conform to objects bulging out of containers (i.e., a head of lettuce). In this respect, it is more useful than conventional rigid lids. Use of the invention is not limited to one predetermined size or shape of container.

Figure 1:
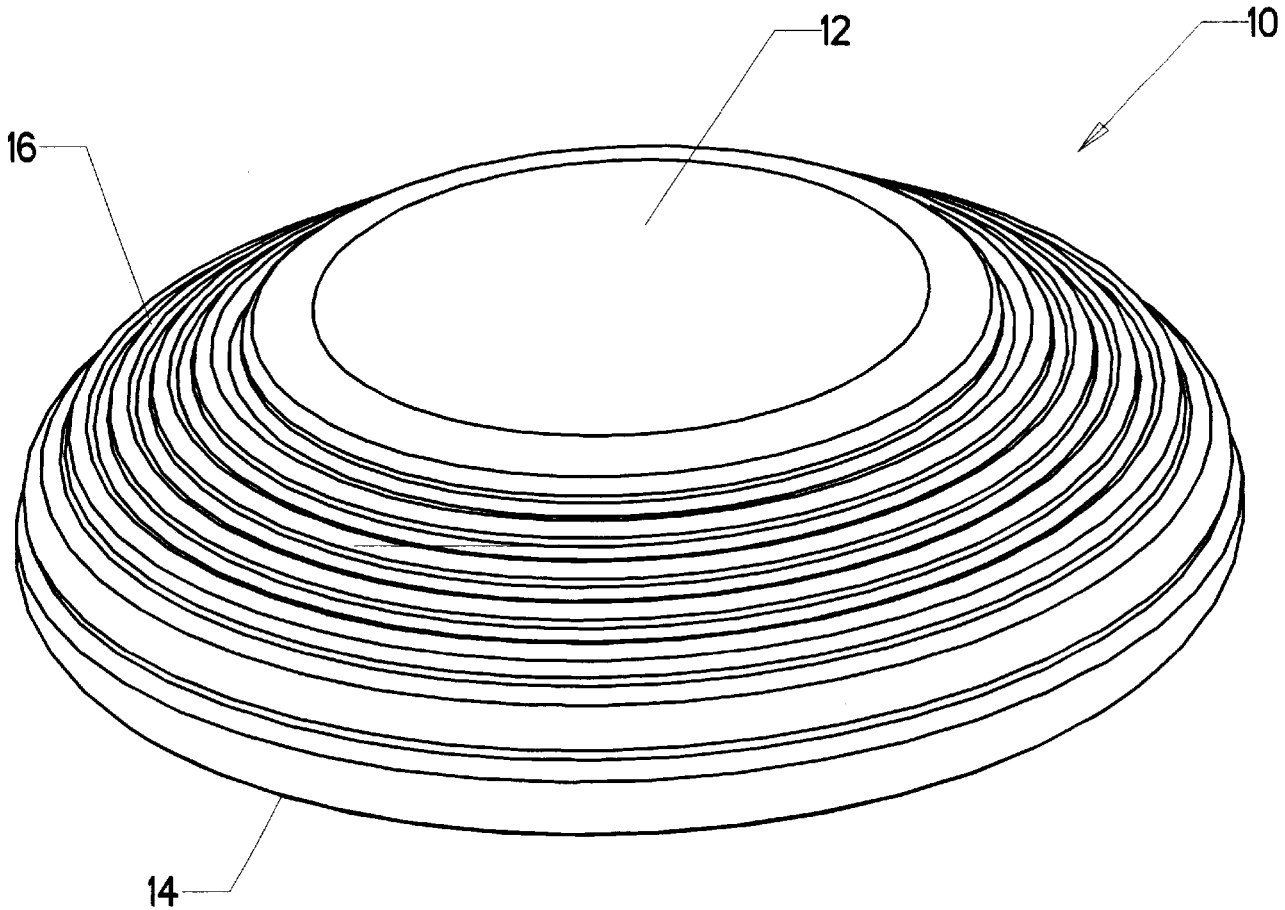
FIG. 1 is an isometric view showing the proposed cover.
Figure 2:
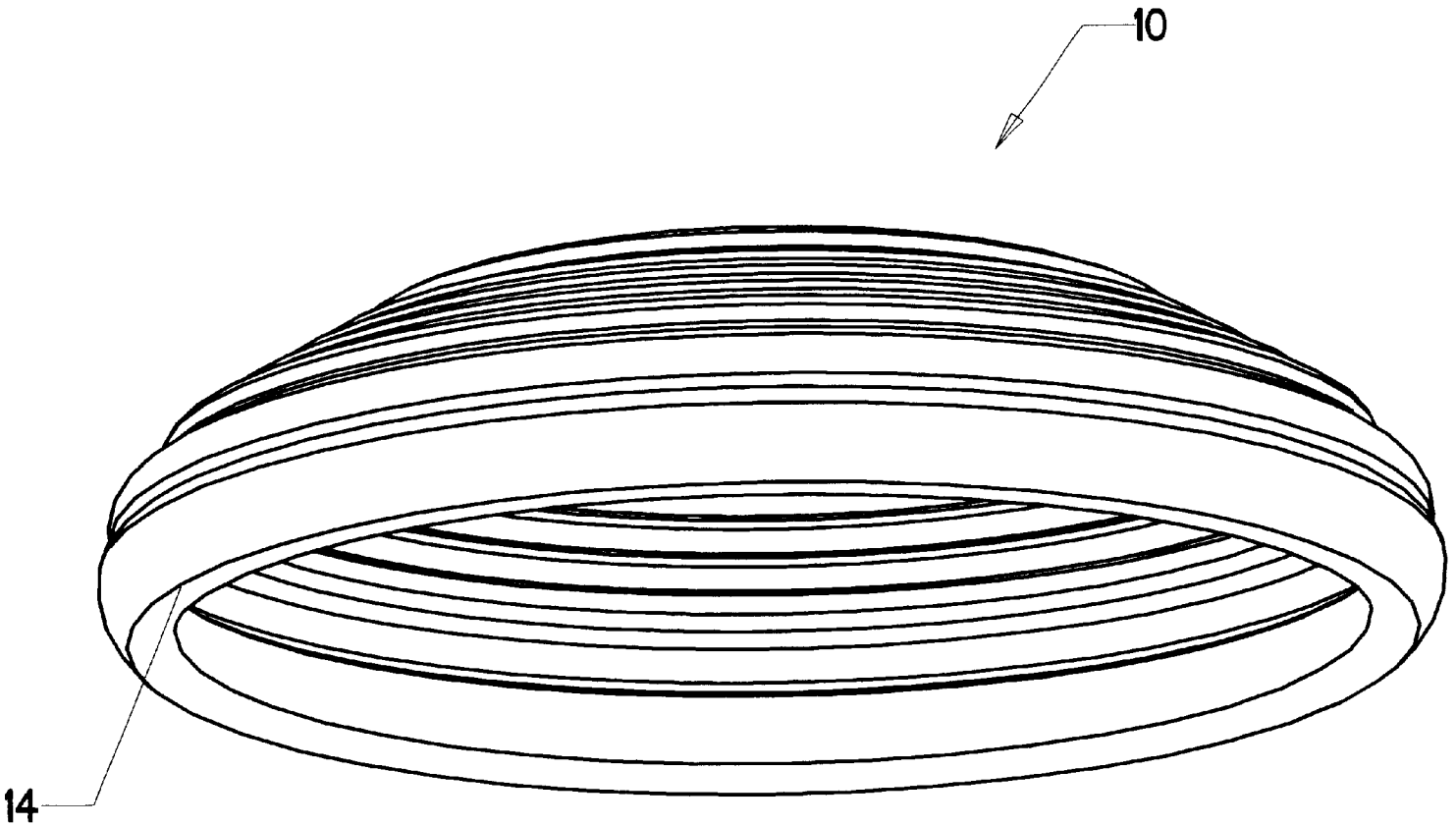
FIG. 2 is an isometric view showing the underside of the proposed cover.
Figure 3:
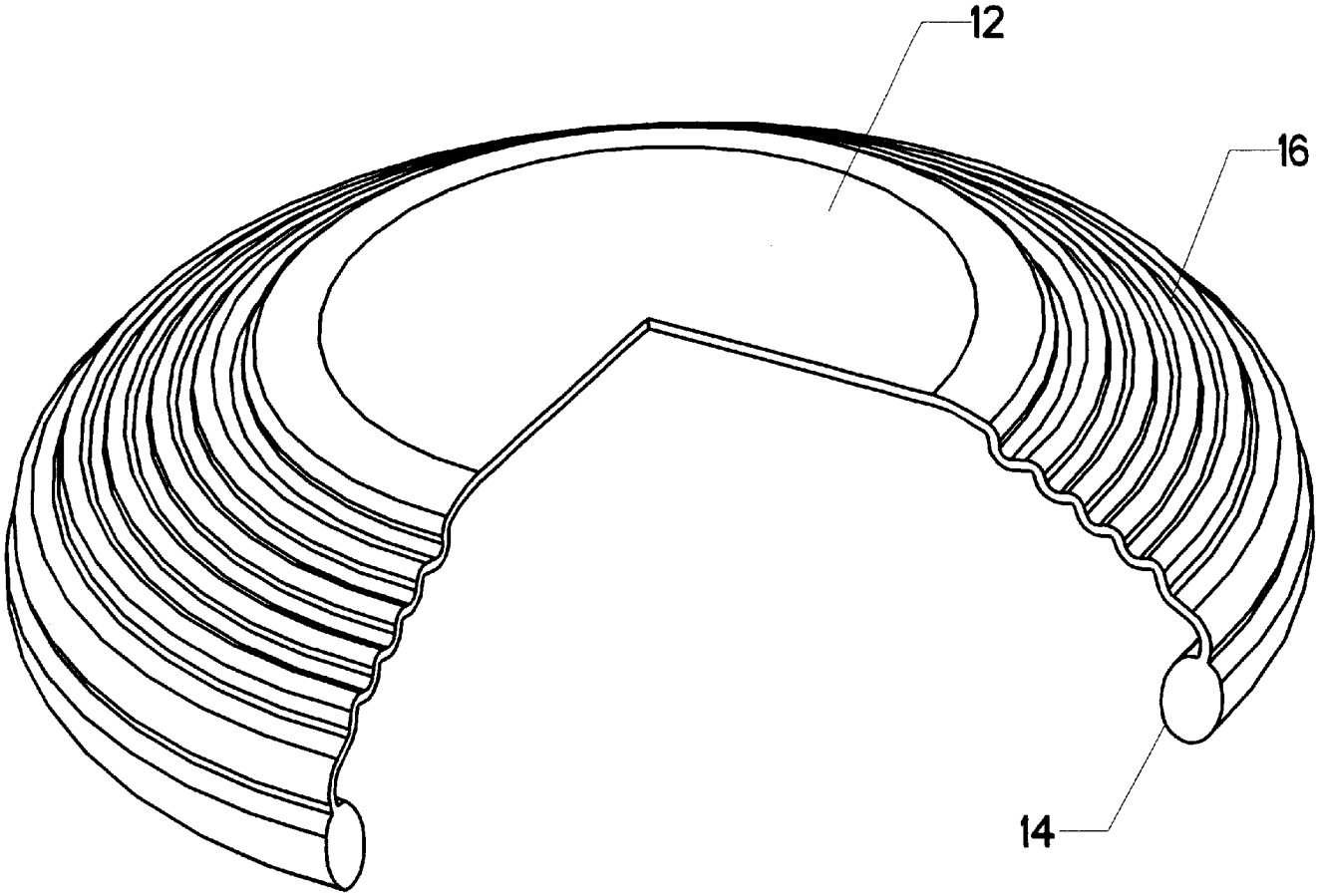
FIG. 3 is a cutaway view showing the cross section of the proposed cover.

FIG. 1 shows an isometric view of the proposed invention. Cover 10 is composed of three elements molded as an integral unit: top panel 12, accordion section 16, and gasket ring 14. FIG. 2 shows the same device rotated slightly about the horizontal axis. The reader will observe that cover 10 is a hollow, thin-walled structure. FIG. 3 shows cover 10 with a cutaway to reveal its thin-walled nature. The reader will observe that it has a constant wall thickness, other than in the region of gasket ring 14.

Figure 4:
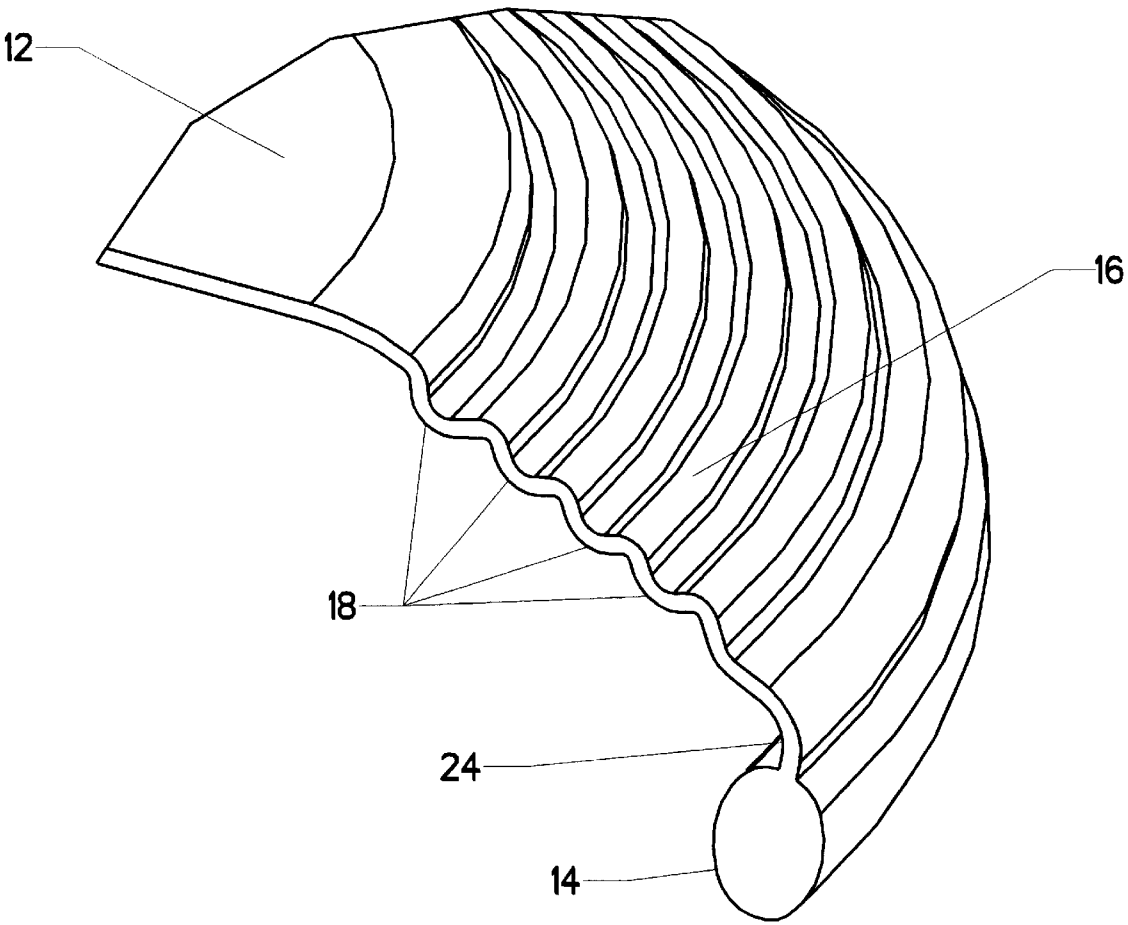
FIG. 4 is an enlarged view of the same cutaway shown in FIG. 3.

FIG. 4 shows cover 10 in more detail. Accordion section 16 is comprised of a series of corrugations 18, the purpose of which is to allow the diameter of cover 10 to expand considerably. Cover 10 is preferably injection molded from a highly elastic material. While many materials are suitable, FDA-approved silicon has been found particularly effective. Silicon can stretch considerably while still retaining the ability to return to its original shape. It can also be molded in a variety of pleasing transparent or translucent colors. In addition, it is very heat-tolerant—meaning that the invention can be placed in a dishwasher for cleaning.

Figure 5:
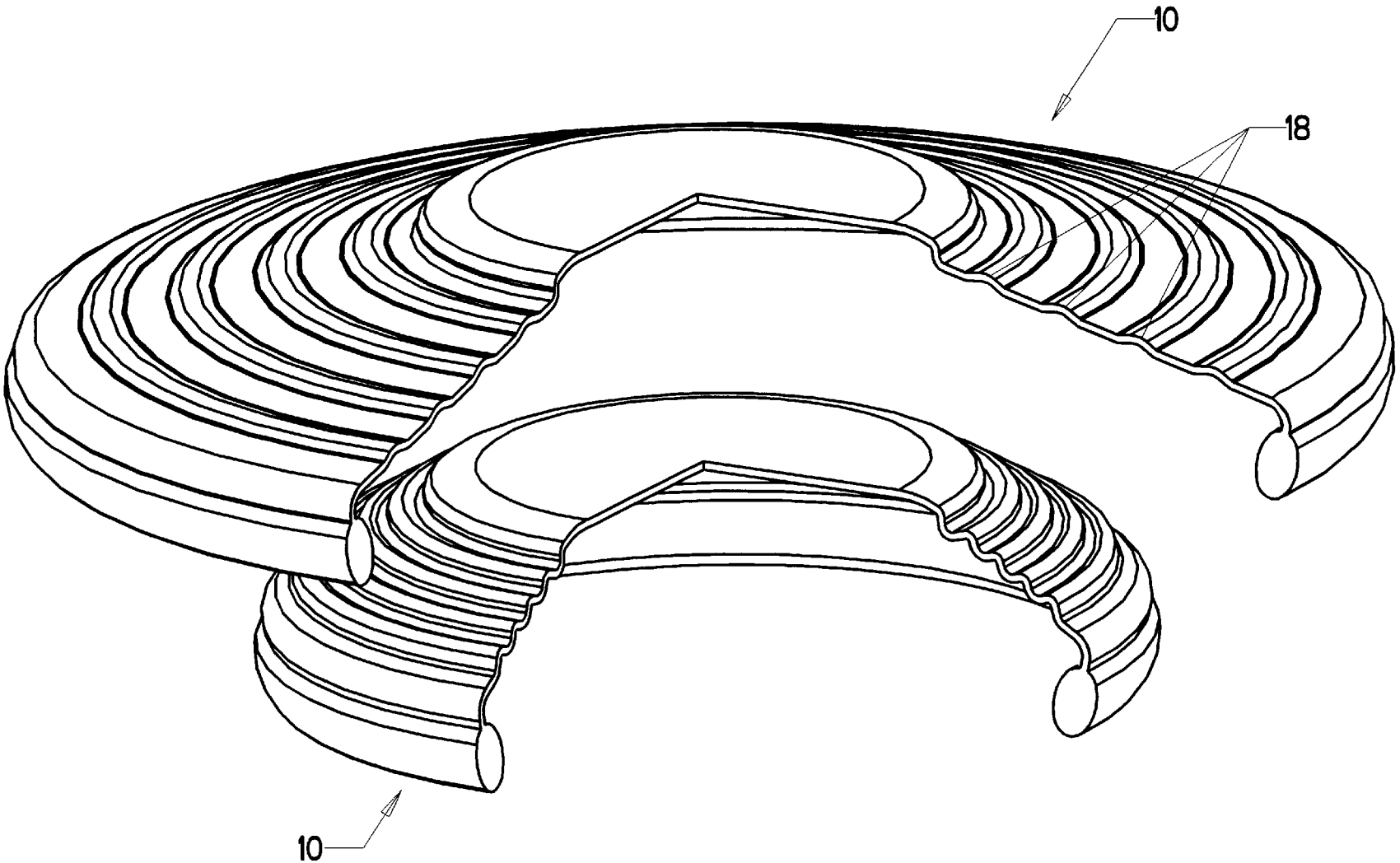
FIG. 5 is a cutaway view comparing the proposed cover in a stretched state to the proposed cover in an unstretched state.

FIG. 5 compares cover 10 in a stretched state to the unstretched state. The reader will observe that corrugations 18 have flattened out in the stretched state to allow the overall diameter of cover 10 to expand. The elasticity of the material itself allows an additional. degree of expansion. The device utilizes gasket ring 14 as a convenient gripping surface. The user grasps gasket ring 14, using the thumb and fingers, and stretches gasket ring 14 over the container the user desires to cover.

Figure 6:
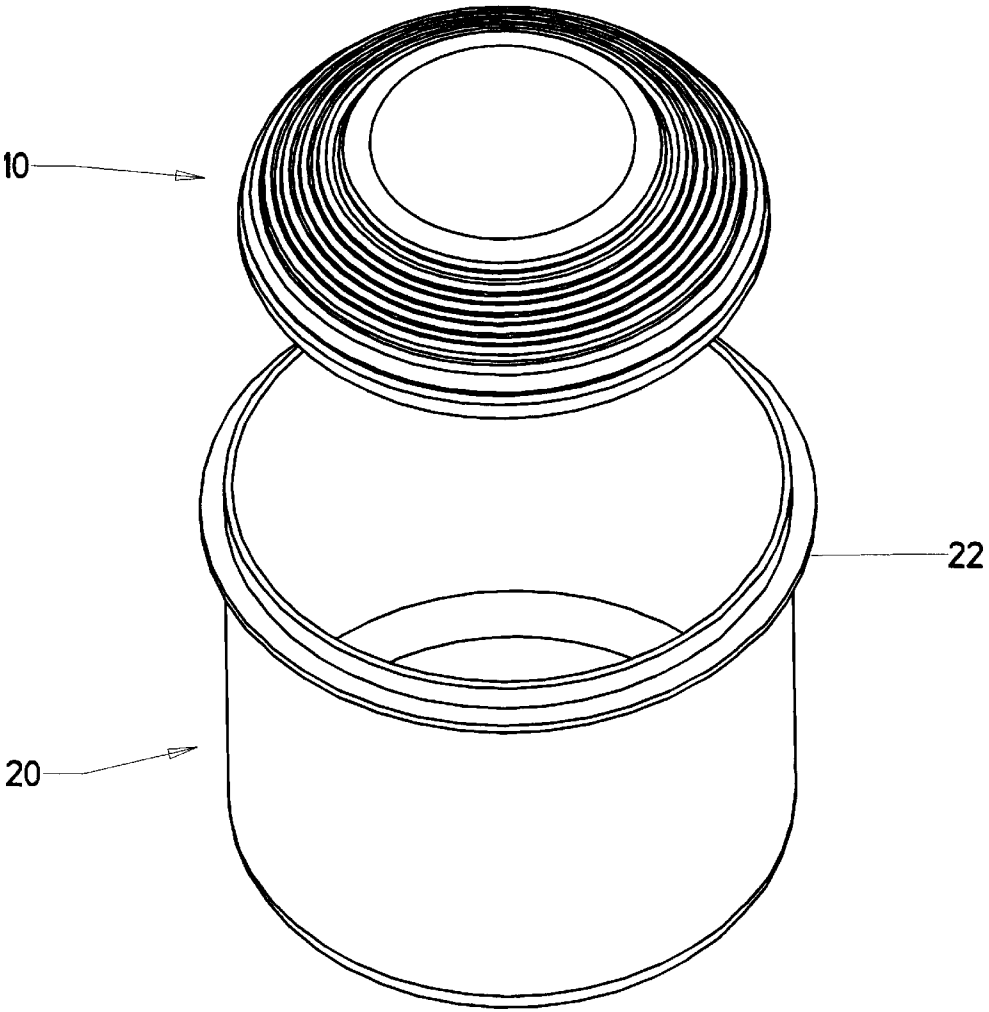
FIG. 6 is an isometric view showing the cover positioned over a container.

FIG. 6 shows cover 10 placed over a typical food container 20. The reader will note that food container 20 has container lip 22 running around its upper circumference. In order to install cover 10 on the container, the user grasps gasket ring 14 and stretches cover 10 outward to enlarge its size. The user then pushes cover 10 down onto the top of food container 20, seating gasket ring 14 over container lip 22. Container lip 22 will naturally be captured within undercut 24 of cover 10.

Figure 7:
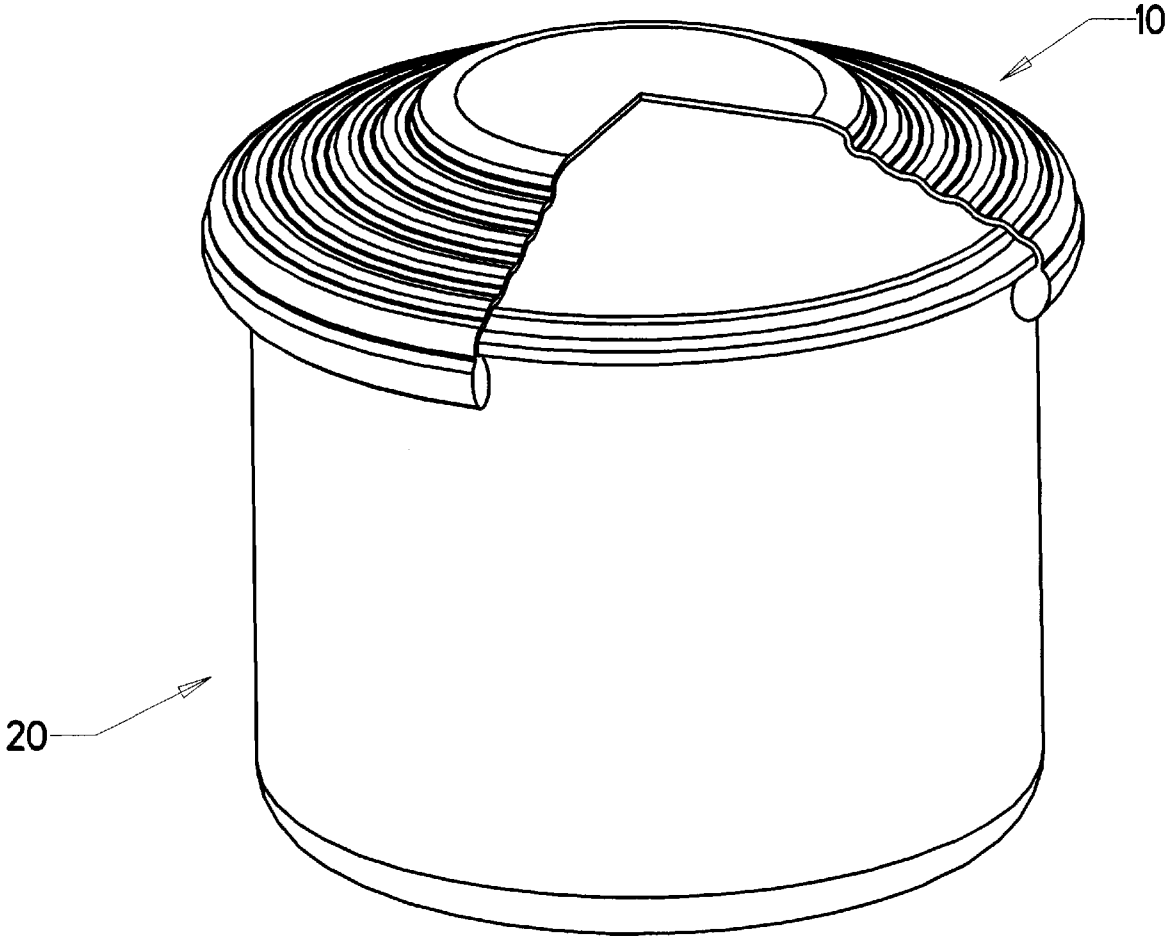
FIG. 7 is a cutaway view showing the cover in place on a container.
Figure 8:
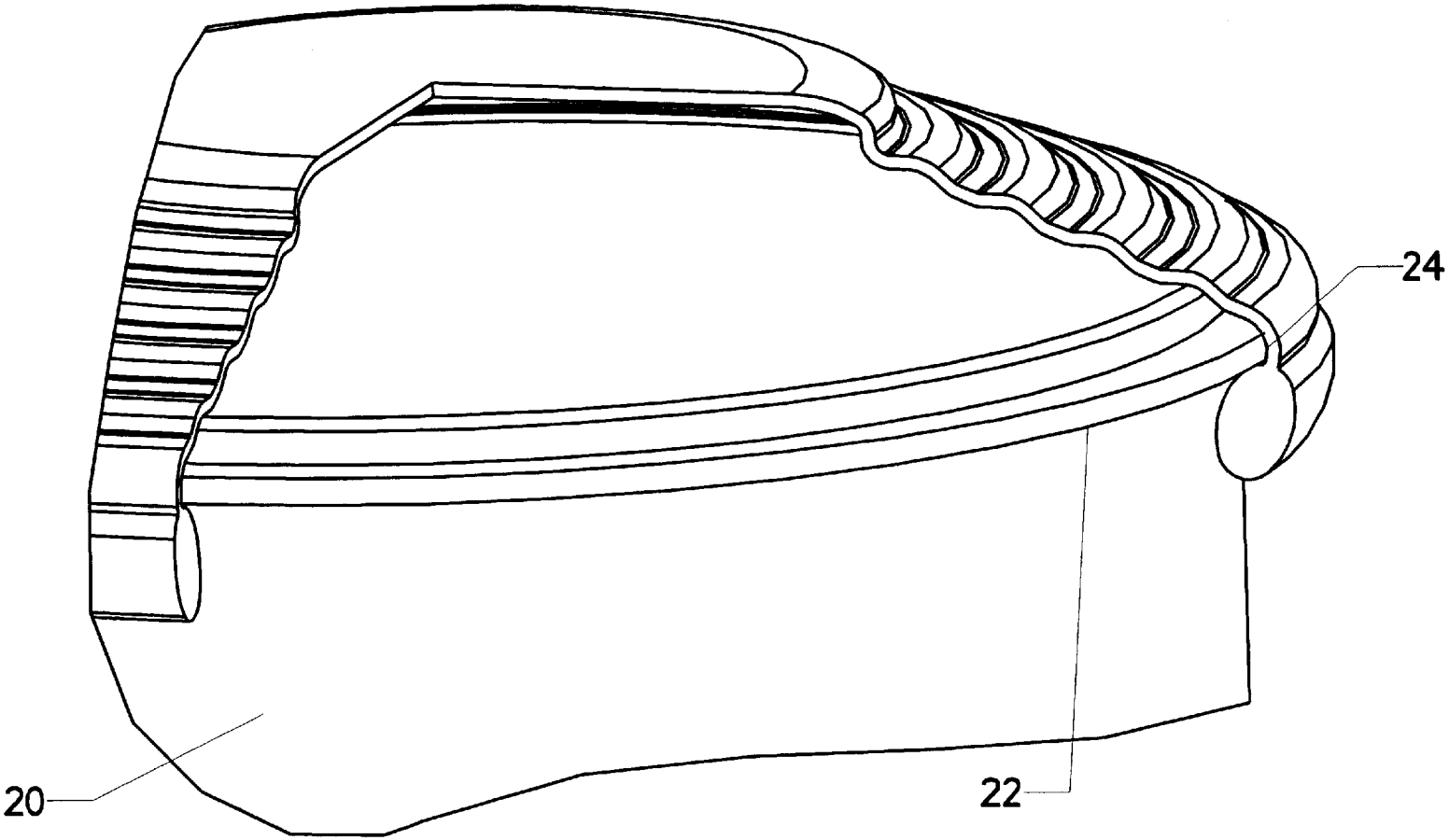
FIG. 8 is an enlarged view of the same cutaway shown in FIG. 8.

FIG. 7 shows a cutaway view of cover 10 in position on container 20. FIG. 8 shows an enlargement of the same view. Those skilled in the art will realize that cover 10 is in tension as shown, because of the natural tendency of the elastic material to return to its unstretched shape. It is held in place by the fact that gasket ring 14 is pulled against container lip 22. The pliable nature of the silicon material means that gasket ring 14 is seated firmly against container lip 22 all the way around container 20. In order to remove cover 10, the user simply grasps gasket ring 14 and pulls it over container lip 22.

Those skilled in the art will realize that one size of cover 10 may be employed to cover a wide variety of containers. Although a circular container has been illustrated, the device will also cover square and oval containers, as well as a variety of serving dishes. There is also some advantage to making cover 10 in an oval shape, in order to accommodate square or elongated containers.

Of course, there is a limit to how far the material of cover 10 may be stretched. It is therefore desirable to have several different sizes of cover 10, each of which would cover a range of containers. As an example, a small size of container 10 could have an overall diameter of 3 inches, while a large size could have an overall diameter of 6 inches.

SUMMARY, RAMIFICATIONS, AND SCOPE

The simplicity, usefulness, and broad applicability of the invention make it a valuable food storage device. It can eliminate the need to find the exact lid for each container. It can also conform to objects bulging out of a container or dish. The invention also has additional advantages in that:

1. It can be washed and reused numerous times;
2. It can be cheaply mass produced; and
3. It can be washed in a conventional dishwasher.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described our invention, we claim:

1. A food storage sealing device allowing a user to seal a plurality of different containers by frictionally engaging a lip of one of said containers with said sealing device, comprising:

a. a top panel, being approximately circular in shape;

b. a gasket ring, also being approximately circular in shape, positioned below said top panel, and having an outer diameter greater than the diameter of said top panel;

c. an according section, encompassing a plurality of corrugations, connecting said gasket ring to said top panel, wherein said corrugations allow said gasket ring to expand considerably in size while still remaining attached to said top panel; and d. wherein said top panel, said gasket ring, and said accordion section are formed as an integral unit from a resilient material.

2. The article as recited in claim 1, wherein said gasket ring further comprises an undercut positioned to frictionally engage said lip of said container.

3. The article as recited in claim 2, wherein said gasket ring is sufficiently large to allow said user to grip said gasket ring and slip it over said lip of said container.

* * * * *